US006572454B1

(12) United States Patent
Yoon et al.

(10) Patent No.: US 6,572,454 B1
(45) Date of Patent: Jun. 3, 2003

(54) APPARATUS AND METHOD OF CONDITIONING POLISHING PADS OF CHEMICAL-MECHANICAL POLISHING SYSTEM

(75) Inventors: Jeong-Goo Yoon, Suwon (KR); Ju-Young Park, Suwon (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/011,315

(22) Filed: Dec. 11, 2001

(30) Foreign Application Priority Data

Nov. 13, 2001 (KR) ..... 2001-70572

(51) Int. Cl.[7] ..... B24B 1/00

(52) U.S. Cl. ..... 451/56; 451/41; 451/58; 451/287; 451/288; 451/443; 451/444

(58) Field of Search ..... 451/41, 56, 58, 451/287, 288, 443, 444

(56) References Cited

U.S. PATENT DOCUMENTS 5,664,987 A * 9/1997 Renteln ..... 451/21
5,846,336 A 12/1998 Skrovan
5,938,507 A * 8/1999 Ko et al. ..... 451/56
6,116,989 A * 9/2000 Balastik ..... 451/72
6,200,199 B1 * 3/2001 Gurusamy et al. ..... 451/56

* cited by examiner

*Primary Examiner*—Joseph J. Hail, III
*Assistant Examiner*—Shantese McDonald
(74) *Attorney, Agent, or Firm*—Lowe Hauptman Gilman & Berner, LLP

(57) ABSTRACT

An apparatus for conditioning the polishing pads of a chemical-mechanical polishing system includes a tool having a cutting tip and positioned almost perpendicular to the surface of the polishing pad arranged on a rotary surface table of the system. The apparatus also has a horizontal moving unit for moving the tool in a direction almost parallel to the surface of the polishing pad, a base unit positioned at a side of the rotary surface table and supporting the horizontal moving unit, and a vertical moving unit for adjusting a vertical position of the tool relative to the surface of the polishing pad. The conditioning apparatus precisely determines a target depth of cut in a polishing pad by moving the tool in a vertical direction, thus allowing the tool to precisely flatten the surface of the polishing pad during a conditioning process. The apparatus also quickly and uniformly flattens the entire surface of a polishing pad by moving the tool on the pad in a direction parallel to the surface of the pad by a radius of the pad or longer distance during a rotation of the pad.

7 Claims, 3 Drawing Sheets

APPARATUS AND METHOD OF CONDITIONING POLISHING PADS OF CHEMICAL-MECHANICAL POLISHING SYSTEM

BACKGROUND OF THE INVENTION

1. Field of the Invention

The present invention relates, in general, to an apparatus for conditioning polishing pads and, more particularly, to an apparatus for conditioning the polishing pads of a chemical-mechanical polishing system.

2. Description of the Prior Art

In a process of producing semiconductor devices, such as CMOS, an etchback process or chemical-mechanical polishing process has been typically used for flattening the surfaces of wafers to a desired level. Of the above-mentioned two processes, the chemical-mechanical polishing process (hereinbelow, referred to simply as "CMP process") has been more preferably used since it more precisely flattens the surfaces of wafers and gives desired flatness to the wafers.

The CMP process performs a mechanical polishing using a polishing pad and a chemical polishing using polishing slurry at the same time. During such a CMP process, the polishing pad is gradually and partially abraded as time goes by, so the pad fails to desirably polish the surface of a wafer or accomplish desired flatness of the wafer's surface. In such a case, it is almost impossible to accomplish almost impossible to accomplish intrawafer regional flatness or interwafer flatness, which are the final aim of the CMP process.

It is thus necessary to rework such partially abraded polishing pads, and the reworking of the polishing pads is so-called "conditioning" in the field, and has been typically performed by a pad conditioner.

FIGS. 1*a* and 1*b* are views showing a conventional disc-type diamond conditioner and a method of conditioning a polishing pad using the diamond conditioner.

As shown in FIG. 1*a*, the conventional disc-type diamond conditioner 10 comprises a disc body 2 made of stainless steel, with diamonds 6 having a diameter of several ten micrometers and fixed to the lower surface of the disc body 2 using a nickel or chrome plating layer 4. The diamond conditioner 10 is placed on a polishing pad 14 seated on a rotary surface table 12, and is rotated by a drive unit 16, thus grinding the surface of the polishing pad 14 to a desired depth by the diamonds 6. The polishing pad 14 is thus reworked such that it has a desired flatness.

Such a conditioning process must be periodically performed during a CMP process such that the surface of a polishing pad maintains a desired flatness of not higher than 2 $\mu$m.

However, the conventional conditioning process using such a diamond conditioner is problematic in that it has a low conditioning efficiency due to frictional point contact of the diamonds with the surface of the polishing pad and uneven cutting angles of the diamonds. In order to overcome such a problem, the diamond conditioner is pressed onto the surface of the polishing pad under high pressure. However, the polishing pad is typically made of a synthetic polyurethane material, and so the conditioning process may be not smoothly performed when the conditioner even slightly excessively compresses the polishing pad. It is also almost impossible to give a desired flatness of not higher than 2 $\mu$m to the surface of the polishing pad.

In addition, the nickel or chrome plating layer 4 fixing the diamonds 6 to the lower surface of the conditioner 10 is also ground during the pad conditioning process, and so the diamonds 6 may be popped-out from the conditioner 10 and undesirably driven into the polishing pad 14.

The diamonds, driven into the polishing pad, scratch the wafer's surface during a CMP process, thus reducing the quality of wafers. Therefore, such polishing pads, into which diamonds are driven, must be replaced with new pads, and the conditioner from which diamonds are popped-out must be replaced with a new one. This increases the processing cost of a CMP process, including a pad conditioning process.

Therefore, it is necessary to provide an apparatus and method of conditioning such polishing pads, which gives a desired flatness to the pads without allowing the pads to form scratches on the surfaces of wafers due to popping-out of diamonds during a CMP process.

SUMMARY OF THE INVENTION

Accordingly, the present invention has been made keeping in mind the above problems occurring in the prior art, and an object of the present invention is to provide an apparatus for conditioning the polishing pads of a CMP system, which positions a tool having a cutting tip at a side of a polishing pad such that the cutting tip is aligned with a target depth of cut in the pad, and which moves the tool on the pad in a radial direction of the pad at a constant velocity while rotating the pad, thus conditioning the pad.

In order to accomplish the above objects, the present invention provides an apparatus for conditioning the polishing pads of a CMP system, comprising: a tool having a cutting tip and positioned almost perpendicular to the surface of a polishing pad arranged on the rotary surface table of the system, a horizontal moving unit for moving the tool in a direction almost parallel to the surface of the polishing pad, a base unit positioned at a side of the rotary surface table and supporting the horizontal moving unit, and a vertical moving unit for adjusting a vertical position of the tool relative to the surface of the polishing pad.

The apparatus of this invention preferably further comprises an inclination control unit for adjusting an angle of inclination of the horizontal moving unit relative to the surface of the polishing pad, thus allowing the tool to move horizontally in a direction precisely parallel to the pad's surface.

In the preferred embodiment of this invention, the horizontal moving unit comprises a horizontal slide arm holding the tool at a first end thereof, a horizontal casing connected to a second end of the horizontal slide arm and having a guide rail for guiding a horizontal movement of the slide arm relative to the horizontal casing, and a drive unit for moving the slide arm along the guide rail of the horizontal casing. In such a case, the vertical moving unit preferably comprises a first level screw provided at the first end of the horizontal slide arm for adjusting the vertical position of the tool relative to the surface of the polishing pad.

In the preferred embodiment, the inclination control unit comprises a second level screw provided at the base unit for moving one end of the horizontal casing in a vertical direction, and a hinge joint connecting a predetermined portion of the horizontal casing to the base unit and adjusting the angle of inclination of the horizontal casing relative to the surface of the polishing pad in response to an operation of the second level screw.

In the present invention, a diamond tip is preferably used as the cutting tip of the tool.

Different from a conventional conditioning apparatus flattening the surface of a polishing pad through a grinding process with surface to surface contact between the pad and a disc-type diamond conditioner, the conditioning apparatus of this invention conditions the surface of a polishing pad by moving a tool with a cutting tip on the pad's surface while rotating the pad after positioning the tool on the pad's surface such that the cutting tip is aligned with a target depth of cut in the pad.

That is, during a rotation of the polishing pad on the rotary surface table of the CMP system, the tool having the cutting tip is horizontally moved on the pad's surface in a direction from the edge to the center or from the center to the edge, thus uniformly flattening the entire surface of the polishing pad while overcoming the problem of the conventional disc-type diamond conditioner causing inferior flatness of the pad's surface due to both uneven distribution of vertical pressures and a difference in rotating force between the inside and outside portions of the diamond conditioner.

In the apparatus [and method] of the present invention, a tool having a cutting tip is used during a conditioning process. This tool gives a desired flatness to the polishing pads without allowing the pads to form scratches on the surfaces of wafers due to popping-out of diamonds during a CMP process, different from a conventional disc-type diamond conditioner.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1A:
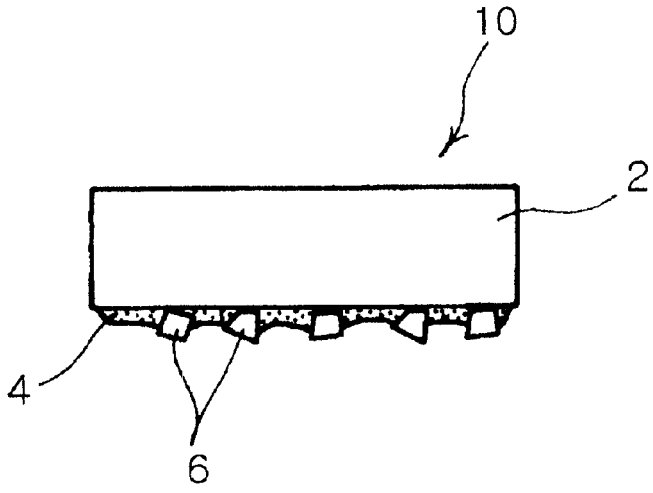
PRIOR ART FIG. 1a
FIG. 1*a* is a sectional view of a conventional disc-type diamond conditioner used for conditioning a polishing pad in the prior art.
Figure 1B:
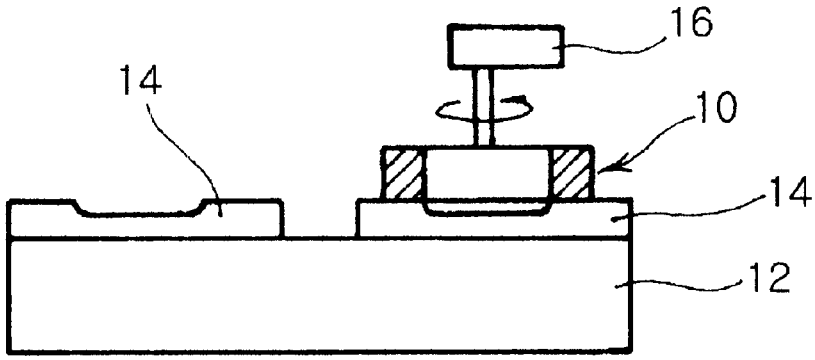
PRIOR ART FIG. 1b
FIG. 1*b* is a view showing a method of conditioning a polishing pad using the diamond conditioner of FIG. 1.

Reference now should be made to the drawings, in which the same reference numerals are used throughout the different drawings to designate the same or similar components.

Figure 2:
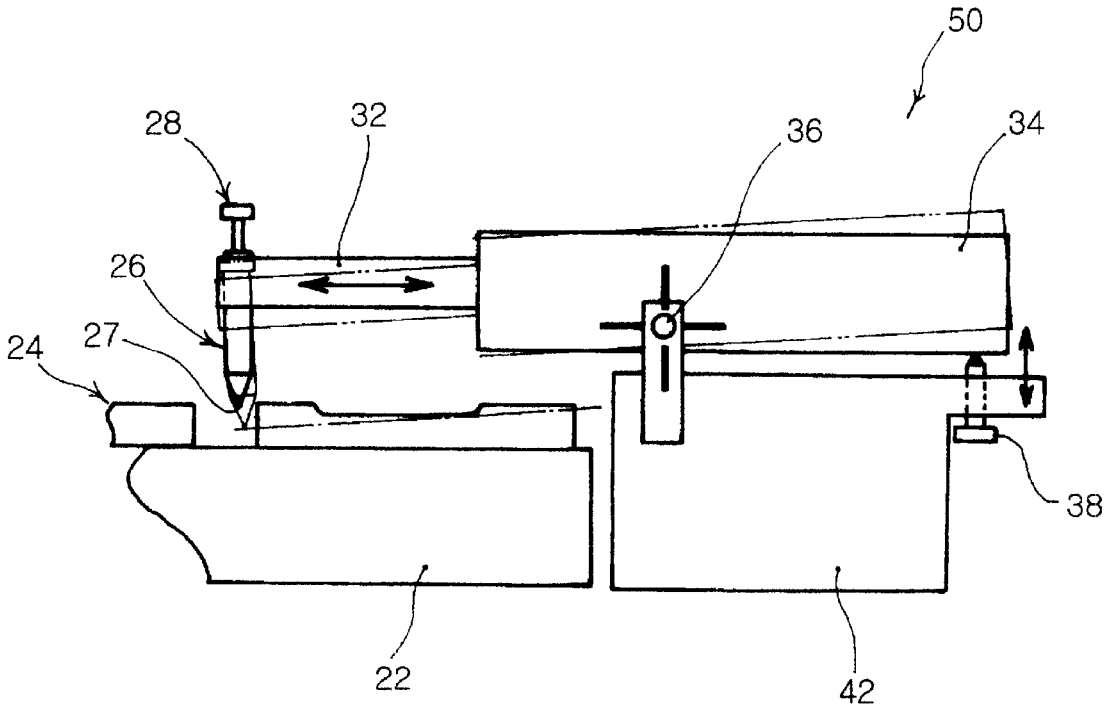
FIG. 2 is a polishing pad conditioning apparatus in accordance with the preferred embodiment of the present invention.

FIG. 2 is a polishing pad conditioning apparatus in accordance with the preferred embodiment of the present invention. As shown in the drawing, the conditioning apparatus 50 of this invention is included in a CMP system, and is installed at a side of a rotary surface table 22 on which a plurality of polishing pads 24 are arranged.

The conditioning apparatus 50 comprises a tool 26, a horizontal moving unit, a base unit 42, and a vertical moving unit. The tool 26 has a cutting tip 27 at the end thereof and is positioned almost perpendicular to the surface of a polishing pad 24 arranged on the rotary surface table 22 of the CMP system. The horizontal moving unit has a horizontal slide arm 32 holding the tool 26 at a first end thereof and moving the tool 26 in a direction almost parallel to the surface of the polishing pads 24. The horizontal moving unit also has a horizontal casing 34 forming a horizontal movement guide path for the horizontal moving arm 32. That is, the horizontal casing 34 is connected to the second end of the horizontal slide arm 32 and has a guide rail for guiding a horizontal movement of the slide arm 32 relative to the horizontal casing 34. The horizontal moving unit further includes a drive unit for horizontally moving the slide arm 32 along the guide rail of the horizontal casing 34. The base unit 42 supports the horizontal casing 34 of the horizontal moving unit. The vertical moving unit has a first level screw 28 adjusting a vertical position of the tool 26 relative to the surface of the polishing pad 24.

The conditioning apparatus 50 also has an inclination control unit for adjusting the angle of inclination of the horizontal movement guide path for the horizontal slide arm 32 relative to the surface of the polishing pads 24. As shown in FIG. 2, the inclination control unit comprises a second level screw 38 provided at the base unit 42, and a hinge joint 36 connecting a predetermined portion of the horizontal casing 34 to the base unit 42. The inclination control unit thus precisely controls the angle of inclination of the movement path of the horizontal slide arm 32, moving along the guide rail of the horizontal casing 34, relative to the surface of the polishing pad 24.

Figure 3A:
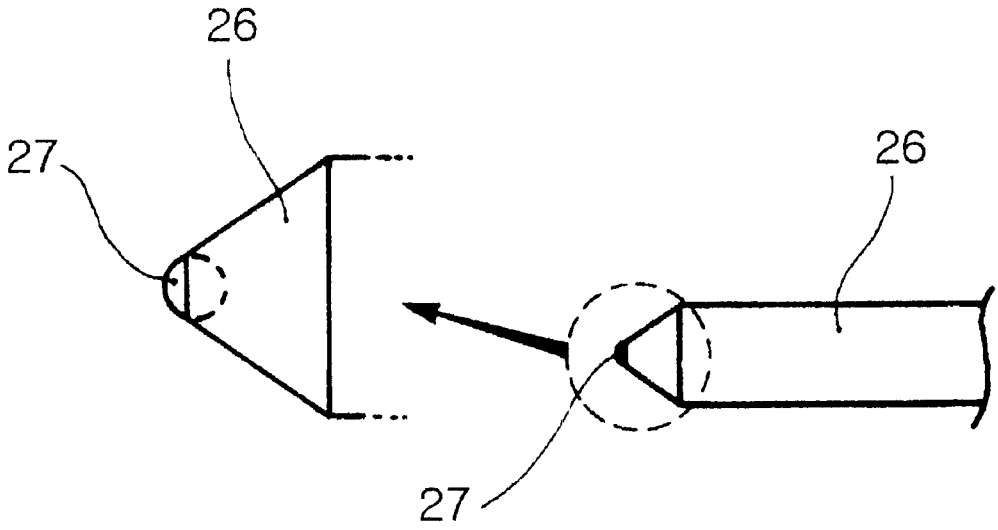
FIGS. 3*a* and 3*b* are side views of tools used in the conditioning apparatus of the present invention.
Figure 3B:
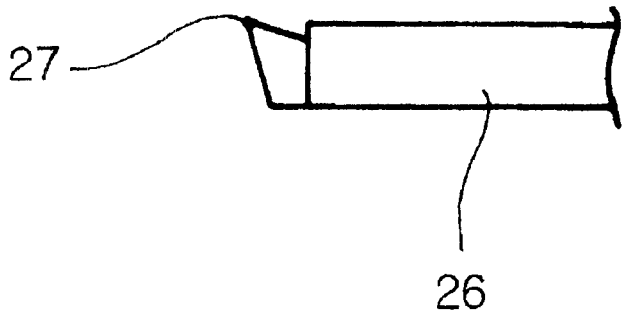

FIGS. 3*a* and 3*b* are side views of tools 26 used in the conditioning apparatus 50 of this invention.

In the tool 26 of FIG. 3*a*, the cutting edge is machined to have a rake angle of about 90°, and is provided with a cutting tip 27. In the present invention, a diamond tip having high hardness is preferably used as the cutting tip 27. In the preferred embodiment, a diamond having a diameter of about 1 mm is used as the cutting tip 27. In the tool 26 of FIG. 3*b*, the cutting edge is machined to have a relief angle of about 6° suitable for smoothly discharging chips from the cutting edge during a conditioning process.

The operational effect of the conditioning apparatus 50 of this invention will be described herein below in conjunction with FIG. 2.

In order to condition a polishing pad 24 using the conditioning apparatus 50, the tool 26 having the cutting tip 27 is primarily positioned on the central portion of the surface of the polishing pad 24 so as to set a conditioning start point on the pad 24. Of course, the conditioning start point on the pad 24 may be determined by positioning the tool 26 on the outside surface of the polishing pad in place of the inside surface. However, the rotating force of the pad 24 is stronger at the outside surface than the inside surface, and so the position of the tool 26 may be undesirably changed at the initial stage of the conditioning process. Therefore, it is preferable to position the tool 26 on the inside surface of the pad 24 rather than the outside surface when setting the conditioning start point.

Thereafter, the first level screw 28 is operated to move the tool 26 in a vertical direction, thus precisely determining a target depth of cut in the pad 24 to be desirably flattened. In such a case, the term "target depth of cut" in the pad 24 denotes a minimum depth to which the surface of the pad 24 is cut by the cutting tip 27 of the tool 26 during the conditioning process. Such a target depth of cut is determined by the vertical position of the cutting tip 27 relative to the surface of the pad 24, and so it is possible to precisely control the target depth of cut in the pad 24 by moving the tool 26 in the vertical direction by an operation of the first level screw 28. In the present invention, it is preferable to design the first level screw 28 such that the screw 28 is moved in the unit of $\mu$m for accomplishing a desired surface precision of the pad 24.

After determining the target depth of cut in the polishing pad 24, the rotary surface table 22 is rotated about the center thereof, thus rotating the pad 24 at a desired rotating velocity, for example, 150~300 rpm. During such a rotation of the polishing pad 24, the horizontal slide arm 32 is moved horizontally along the guide rail of the horizontal casing 34 by the drive unit, thus moving the tool 26 on the surface of the pad 24 in a direction parallel to the surface of the pad 24 by a radius of the pad 24 or longer distance. In such a case, the tool 26 is horizontally moved on the surface of the rotating pad 24 at a velocity of several ten millimeters per minute. In addition, such a horizontal moving velocity of the tool 26 is almost constantly maintained during the conditioning process, thus uniformly cutting the entire surface of the pad 24 to accomplish a desired flatness of the pad 24.

The horizontal moving velocity of the tool 26 on the surface of the pad 24 is determined in accordance with the rotating velocity of the pad 24 such that the entire surface of the pad 24 is sufficiently cut to the target depth by the cutting tip 27. When the rotating velocity of the pad 24 is higher than a reference level, the horizontal moving velocity of the tool 26 is increased to increase the cutting speed. However, the position of the tool 26 may be changed in accordance with the rotating velocity of the polishing pad 24, and so it is preferable to limit the maximum rotating speed of the pad to several hundred rpm. Particularly when the target depth of cut in the pad 24 is set to a high level, a high rotating velocity of the polishing pad 24 may deteriorate work efficiency during the conditioning process. The determination of both the rotating velocity of the polishing pad 24 and the horizontal moving velocity of the tool 26 according to the target depth of cut in the pad 24 is well known to those skilled in the art, and further explanation is thus not deemed necessary.

In an experiment, a conditioning process using the apparatus 50 of this invention was performed at the rotating velocity of the polishing pad set to about 180 rpm and the horizontal moving velocity of the tool set to about 50 mm/min. The conditioning apparatus using the tool of this invention finished the conditioning process within above 5 minutes different from a conventional disc-type diamond conditioner consuming about 15 minutes for finishing the process.

In the conditioning process of this invention, it is very important to make the tool horizontally move in a direction parallel to the surface of a polishing pad for accomplishing a desired flatness of the pad's surface. Such a horizontal movement of the tool relative to the surface of the polishing pad is accomplished by arranging both the horizontal slide arm and the guide rail of the horizontal casing such that they are positioned in parallel to the pad's surface. However, the tool may sometimes fail to move horizontally in parallel to the pad's surface due to a structural deformation of the horizontal moving unit caused by an external force or the condition of the pad laid on the rotary surface table. In order to overcome such a problem, the conditioning apparatus of this invention has the inclination control unit.

The inclination control unit comprises the hinge joint 36 and the second level screw 38 as shown in FIG. 2. When it is desired to control the angle of inclination of the movement path of the horizontal slide arm 32 relative to the surface of the polishing pad 24 and make the tool 26 horizontally move in a direction parallel to the pad's surface, the end of the horizontal casing 34 hinged to the base unit 42 is moved in a vertical direction by an operation of the second level screw 38 provided at the end of the base unit 42.

As described above, the present invention provides an apparatus and method of conditioning the polishing pads of a CMP system. In order to condition the surface of a polishing pad of the CMP system, a tool with a cutting tip is primarily positioned on an inside or outside surface of the polishing pad. Thereafter, the tool is moved in a vertical direction so as to align the cutting tip of the tool with a target depth of cut in the pad. The polishing pad is rotated around its center, while the tool is moved on the pad in a direction parallel to the surface of the pad during the rotation of the pad. Therefore, the conditioning apparatus and method of this invention precisely determines a target depth of cut in the polishing pad by moving the tool in a vertical direction using a first level screw, thus allowing the tool to precisely flatten the surface of the polishing pad. In addition, the apparatus and method of this invention quickly and uniformly flattens the entire surface of the polishing pad by moving the tool on the pad's surface in a horizontal direction while rotating the pad.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An apparatus for conditioning a polishing pad of a chemical-mechanical polishing system, comprising:

a tool having a cutting tip and positioned almost perpendicular to a surface of the polishing pad arranged on a rotary surface table of the system;

a horizontal moving unit for moving the tool in a direction almost parallel to the surface of the polishing pad;

a base unit positioned at a side of the rotary surface table and supporting the horizontal moving unit;

a vertical moving unit for adjusting a vertical position of the tool relative to the surface of the polishing pad; and an inclination control unit for adjusting an angle of inclination of the horizontal moving unit relative to the surface of the polishing pad.

2. The apparatus according to claim 1, wherein said horizontal moving unit comprises:

a horizontal slide arm holding the tool at a first end thereof;

a horizontal casing connected to a second end of the horizontal slide arm and having a guide rail for guiding a horizontal movement of the slide arm relative to the horizontal casing; and a drive unit for moving the slide arm along the guide rail of the horizontal casing.

3. The apparatus according to claim 2, wherein said vertical moving unit comprises a first level screw provided at the first end of the horizontal slide arm for adjusting the vertical position of the tool relative to the surface of the polishing pad.

4. The apparatus according to claim 2, wherein the inclination control unit comprises:

a second level screw provided at the base unit for moving one end of the horizontal casing in a vertical direction; and a hinge joint connecting a predetermined portion of the horizontal casing to the base unit and adjusting the angle of inclination of the horizontal casing relative to the surface of the polishing pad in response to an operation of the second level screw.

5. The apparatus according to claim 1, wherein said cutting tip of the tool is a diamond tip.

6. An apparatus for conditioning a polishing pad of a chemical-mechanical polishing system, comprising:

a tool having a cutting tip and positioned almost perpendicular to a surface of the polishing pad arranged on a rotary surface table of the system;

a horizontal moving unit for moving the tool in a direction almost parallel to the surface of the polishing pad;

a base unit positioned at a side of the rotary surface table and supporting the horizontal moving unit;

a vertical moving unit for adjusting a vertical position of the tool relative to the surface of the polishing pad;

wherein said horizontal moving unit comprises:

a horizontal slide arm holding the tool at a first end thereof;

a horizontal casing connected to a second end of the horizontal slide arm and having a guide rail for guiding a horizontal movement of the slide arm relative to the horizontal casing;

a drive unit for moving the slide arm along the guide rail of the horizontal casing; and wherein said vertical moving unit comprises a first level screw provided at the first end of the horizontal slide arm for adjusting the vertical position of the tool relative to the surface of the polishing pad.

7. An apparatus for conditioning a polishing pad of a chemical-mechanical polishing system, comprising:

a tool having a cutting tip and positioned almost perpendicular to a surface of the polishing pad arranged on a rotary surface table of the system;

a horizontal moving unit for moving the tool in a direction almost parallel to the surface of the polishing pad;

a base unit positioned at a side of the rotary surface table and supporting the horizontal moving unit;

a vertical moving unit for adjusting a vertical position of the tool relative to the surface of the polishing pad;

wherein said horizontal moving unit comprises:

a horizontal slide arm holding the tool at a first end thereof;

a horizontal casing connected to a second end of the horizontal slide arm and having a guide rail for guiding a horizontal movement of the slide arm relative to the horizontal casing;

a drive unit for moving the slide arm along the guide rail of the horizontal casing;

a second level screw provided at the base unit for moving one end of the horizontal casing in a vertical direction; and a hinge joint connecting a predetermined portion of the horizontal casing to the base unit and adjusting the angle of inclination of the horizontal casing relative to the surface of the polishing pad in response to an operation of the second level screw.

* * * * *